US006837289B2

(12) United States Patent
Cordonnier et al.

(10) Patent No.: US 6,837,289 B2
(45) Date of Patent: Jan. 4, 2005

(54) MULTI-LAYER STEEL CABLE FOR TIRE CARCASS

(75) Inventors: Francois-Jacques Cordonnier, Clermont-Ferrand (FR); Alain Domingo, Orleat (FR); Henri Barguet, Les Martres-d'Artiere (FR); Le Tu Anh Vo, Guyancourt (FR)

(73) Assignee: Michelin Recherche et Technique, S.A., Granges-Paccot (CH)

( * ) Notice: Subject to any disclaimer, the term of this patent is extended or adjusted under 35 U.S.C. 154(b) by 0 days.

(21) Appl. No.: 10/178,148

(22) Filed: Jun. 24, 2002

(65) Prior Publication Data

US 2004/0108038 A1 Jun. 10, 2004

Related U.S. Application Data

(63) Continuation of application No. PCT/EP00/13290, filed on Dec. 27, 2000.

(30) Foreign Application Priority Data

Dec. 30, 1999 (FR) ..... 99 16842

(51) Int. Cl.[7] ..... B60C 9/00; B60C 9/04; B60C 9/08; D07B 1/06

(52) U.S. Cl. ..... 152/556; 57/213; 57/902; 152/451; 428/295.4

(58) Field of Search ..... 152/556, 451; 57/213, 902; 428/295.4

(56) References Cited

U.S. PATENT DOCUMENTS 6,418,994 B1 7/2002 Arnaud
6,748,989 B2 6/2004 Cordonnier et al.

FOREIGN PATENT DOCUMENTS

EP 0648891 4/1995
EP 0675223 10/1995
EP 0744490 11/1996
EP 0719889 7/1998
WO WO 9841682 9/1998

OTHER PUBLICATIONS

Rsch Discl 3343 [343, Nov '92.

*Primary Examiner*—Adrienne C. Johnstone
(74) *Attorney, Agent, or Firm*—Felipe J. Farley; Christopher P. Crecente; Alan A. Csontos

(57) ABSTRACT

A multi-layer cable having an unsaturated outer layer, usable as a reinforcing element for a tire carcass reinforcement, comprising a core of diameter $d_0$ surrounded by an intermediate layer (C1) of four or five wires (M=4 or 5) of diameter $d_1$ wound together in a helix at a pitch $p_1$, this layer C1 itself being surrounded by an outer layer (C2) of N wires of diameter $d_2$ wound together in a helix at a pitch $p_2$, N being less by 1 to 3 than the maximum number $N_{max}$ of wires which can be wound in one layer about the layer C1, this cable having the following characteristics ($d_0$, $d_1$, $d_2$, $p_1$ and $p_2$ in mm):

$0.08<d_0<0.28$; (i)

$0.15<d_1<0.28$; (ii)

$0.12<d_2<0.25$; (iii)

for $M=4$: $0.40<(d_0/d_1)<0.80$; (iv)

Figure 1:
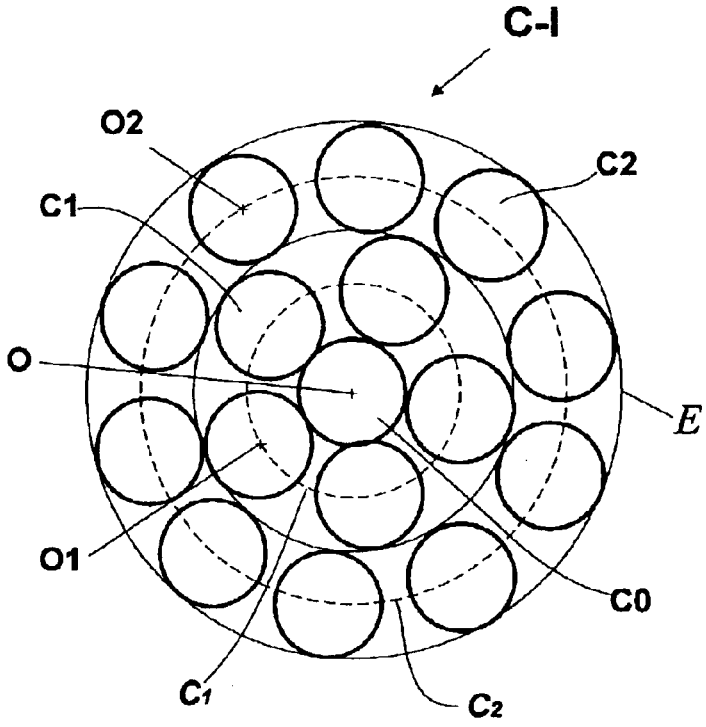

for $M=5$: $0.70<(d_0/d_1)<1.10$;

$4.8\pi(d_0+d_1)<p_1<p_2<5.6\pi(d_0+2d_1+d_2)$; (v)

the wires of layers C1 and C2 are wound in the same direction of twist. (vi)

The invention furthermore relates to the articles or semi-finished products made of plastics material and/or rubber which are reinforced by such a multi-layer cable, in particular to tires intended for industrial vehicles, more particularly truck tires and their carcass reinforcement plies.

53 Claims, 2 Drawing Sheets

MULTI-LAYER STEEL CABLE FOR TIRE CARCASS

The present application is a continuation of International Application No. PCT/EP00/13290 filed 27 Dec. 2000, published in French with an English Abstract on 12 Jul. 2001 under PCT Article 21(2), which itself claims priority to French Patent Application No. 99/16842 filed 30 Dec. 1999.

The present invention relates to steel cables ("steel cords") which can be used for reinforcing rubber articles such as tires. It relates more particularly to the cables referred to as "layered" cables which can be used for reinforcing the carcass reinforcements of tires for industrial vehicles such as truck tires.

Steel cables for tires, as a general rule, are formed of wires of perlitic (or ferro-perlitic) carbon steel, hereinafter referred to as "carbon steel", the carbon content of which is generally between 0.2% and 1.2%, the diameter of these wires most frequently being between 0.10 and 0.40 mm (millimetres). A very high tensile strength is required of these wires, generally greater than 2000 MPa, preferably greater than 2500 MPa, which is obtained owing to the structural hardening which occurs during the phase of work-hardening of the wires. These wires are then assembled in the form of cables or strands, which requires the steels used also to have sufficient ductility in torsion to withstand the various cabling operations.

For reinforcing carcass reinforcements of truck tires, nowadays most frequently so-called "layered" steel cables ("layered cords") or "multi-layer" steel cables formed of a central core and one or more concentric layers of wires arranged around this core. These layered cables, which favour greater contact lengths between the wires, are preferred to the older "stranded" cables ("strand cords") owing firstly to greater compactness, and secondly to lesser sensitivity to wear by fretting. Among layered cables, a distinction is made in particular, in known manner, between compact-structured cables and cables having tubular or cylindrical layers.

The layered cables most widely found in the carcasses of truck tires are cables of the formula (L+M) or (L+M+N), the latter generally being intended for the largest tires. These cables are formed, in known manner, of a core of L wire(s) surrounded by at least one layer of M wires which may itself be surrounded by an outer layer of N wires, with generally L varying from 1 to 4, M varying from 3 to 12, N varying from 8 to 20, if applicable; the assembly may possibly be wrapped by an external wrapping wire wound in a helix around the last layer.

Such layered cables which can be used for reinforcing carcass reinforcements of radial tires, in particular of truck tires, have been described in a very large number of publications. Reference will be made in particular to the documents U.S. Pat. Nos. 3,922,841; 4,158,946; 4,488,587; EP-A-0 168 858; EP-A-0 176 139 or U.S. Pat. No. 4,651,513; EP-A-0 194 011; EP-A-0 260 556 or U.S. Pat. No. 4,756,151; EP-A-0 362 570; EP-A-0 497 612 or U.S. Pat. No. 5,285,836; EP-A-0 568 271; EP-A-0 648 891; EP-A-0 669 421 or U.S. Pat. No. 5,595,057; EP-A-0 675 223; EP-A-0 709 236 or U.S. Pat. No. 5,836,145; EP-A-0 719 889 or U.S. Pat. No. 5,697,204; EP-A-0 744 490 or U.S. Pat. No. 5,806,296 or U.S. Pat. No. 5,822,973; EP-A-0 779 390 or U.S. Pat. No. 5,802,829; EP-A-0 834 613 or U.S. Pat. No. 6,102,095; WO98/41682; RD (Research Disclosure) No. 34054, August 1992, pp. 624–33; RD No. 34370, November 1992, pp. 857–59.

In order to fulfill their function as carcass reinforcements for carcasses for radial tires, the layered cables must first of all have good flexibility and high endurance under flexion, which involves in particular their wires being of relatively low diameter, normally less than 0.28 mm, in particular less than that of the wires used in conventional cables for crown reinforcements for tires.

These layered cables are furthermore subjected to major stresses during travel of the tires, in particular to repeated flexure or variations in curvature, which cause friction at the level of the wires, in particular as a result of the contact between adjacent layers, and therefore of wear, and also of fatigue; they must therefore have high resistance to so-called "fatigue-fretting" phenomena.

Finally, it is important for them to be impregnated as much as possible with rubber, and for this material to penetrate into all the spaces between the wires forming the cables, because if this penetration is insufficient, there then form empty channels along the cables, and the corrosive agents, for example water, which are likely to penetrate into the tires for example as a result of cuts, move along these channels and into the carcass reinforcement of the tire. The presence of this moisture plays an important part in causing corrosion and in accelerating the above degradation processes (so-called "fatigue-corrosion" phenomena), compared with use in a dry atmosphere.

All these fatigue phenomena which are generally grouped together under the generic term "fatigue-fretting-corrosion" are at the origin of gradual degeneration of the mechanical properties of the cables, and may adversely affect the life thereof under very severe running conditions.

In order to improve the endurance of layered cables in truck tire carcass reinforcements in which in known manner the repeated flexural stresses may be particularly severe, it has for a long time been proposed to modify the design thereof in order to increase, in particular, their ability to be penetrated by rubber, and thus to limit the risks due to corrosion and to fatigue-corrosion.

There have for example been proposed or described layered cables of the construction (3+9) or (3+9+15) which are formed of a core of 3 wires surrounded by a first layer of 9 wires and if applicable a second layer of 15 wires, as described, for example, in EP-A-0 168 858, EP-A-0 176 139, EP-A-0 497 612, EP-A-0 669 421, EP-A-0 709 236, EP-A-0 744 490 and EP-A-0 779 390, the diameter of the wires of the core being or not being different from that of the wires of the other layers. These cables cannot be penetrated as far as the core owing to the presence of a channel or capillary at the center of the three core wires, which remains empty after impregnation by the rubber, and therefore favourable to the propagation of corrosive media such as water.

The publication RD No. 34370 describes, for example, cables of the structure [1+6+12], of the compact type or of the type having concentric tubular layers, formed of a core formed of a single wire, surrounded by an intermediate layer of 6 wires which itself is surrounded by an outer layer of 12 wires. The ability to be penetrated by rubber can be improved by using diameters of wires which differ from one layer to the other, or even within one and the same layer. Cables of construction [1+6+12], the ability of which to be penetrated is improved owing to appropriate selection of the diameters of the wires, in particular to the use of a core wire of larger diameter, have been described, for example in EP-A-0 648 891 or WO98/41682.

In order to improve further, relative to these conventional cables, the penetration of the rubber into the cable, there have been proposed or described multi-layer cables having a central core surrounded by at least two concentric layers, in particular cables of the formula [1+M+N] (for example [1+5+10], the outer layer of which is unsaturated (incomplete), thus ensuring better ability to be penetrated by the rubber (see, for example, the aforementioned applications EP-A-0 675 223, EP-A-0 719 889, EP-A-0 744 490 or WO98/41682). The proposed constructions make it possible to dispense with the wrapping wire, owing to better penetration of the rubber through the outer layer and the self-wrapping which results. However, experience shows that these cables are not penetrated right to the center by the rubber, and in any case not adequately.

In any case, an improvement in the ability to be penetrated by the rubber is not sufficient to ensure a sufficient level of performance. When they are used for reinforcing carcass reinforcements of tires, the cables must not only resist corrosion, but also must fulfill a large number of sometimes contradictory criteria, in particular of tenacity, resistance to fretting, high degree of adhesion to rubber, uniformity, flexibility, endurance under repeated flexing, stability under severe flexing, etc.

Thus, for all the reasons set forth previously, and despite the various recent improvements which have been made here or there on such and such a given criterion, the best cables used today in carcass reinforcements for truck tires remain limited to a small number of layered cables of highly conventional structure, of the compact type or the type having cylindrical layers, with a saturated (complete) outer layer; these are essentially cables of constructions [3+9], [3+9+15] or [1+6+12] as described previously.

Now, the Applicant during its research discovered a novel layered cable of the type having an unsaturated outer layer, which unexpectedly improves further the overall performance of the best layered cables known for reinforcing truck tire carcasses. This cable of the invention, owing to a specific structure, not only has excellent ability to be penetrated by the rubber, limiting the problems of corrosion, but also has fatigue-fretting endurance properties which are significantly improved compared with the cables of the prior art.

The longevity of truck tires and that of their carcass reinforcements can thus be substantially improved.

Consequently, a first subject of the invention is a multilayer cable having a unsaturated outer layer, usable as a reinforcing element for a tire carcass reinforcement, comprising a core (C0) of diameter $d_0$ surrounded by an intermediate layer (C1) of four or five wires (M=4 or 5) of diameter $d_1$ wound together in a helix at a pitch $p_1$, this layer C1 itself being surrounded by an outer layer (C2) of N wires of diameter $d_2$ wound together in a helix at a pitch $p_2$, N being less by 1 to 3 than the maximum number $N_{max}$ of wires which can be wound in one layer about the layer C1, this cable being characterised in that it has the following characteristics ($d_0$, $d_1$, $d_2$, $p_1$ and $p_2$ in mm):

$$0.08<d_0<0.28; \quad \text{(i)}$$

$$0.15<d_1<0.28; \quad \text{(ii)}$$

$$0.12<d_2<0.25; \quad \text{(iii)}$$

$$\text{for } M=4: 0.40<(d_0/d_1)<0.80; \quad \text{(iv)}$$

$$\text{for } M=5: 0.70<(d_0/d_1)<1.10;$$

$$4.8\pi(d_0+d_1)<p_1<p_2<5.67\pi(d_0+2d_1+d_2); \quad \text{(v)}$$

the wires of layers C1 and C2 are wound in the same direction of twist. (vi)

The invention also relates to the use of a cable according to the invention for reinforcing articles or semi-finished products made of plastics material and/or of rubber, for example plies, tubes, belts, conveyor belts and tires, more particularly tires intended for industrial vehicles which usually use a metal carcass reinforcement.

The cable of the invention is very particularly intended to be used as a reinforcing element of a carcass reinforcement for a tire intended for industrial vehicles selected from among vans, "heavy vehicles"—i.e. subway trains, buses, road transport machinery (lorries, tractors, trailers), off-road vehicles—agricultural machinery or construction machinery, aircraft, and other transport or handling vehicles.

The invention furthermore relates to these articles or semi-finished products made of plastics material and/or rubber themselves when they are reinforced by a cable according to the invention, in particular tires intended for the industrial vehicles mentioned above, more particularly truck tires, and their carcass reinforcement plies.

Figure 2:
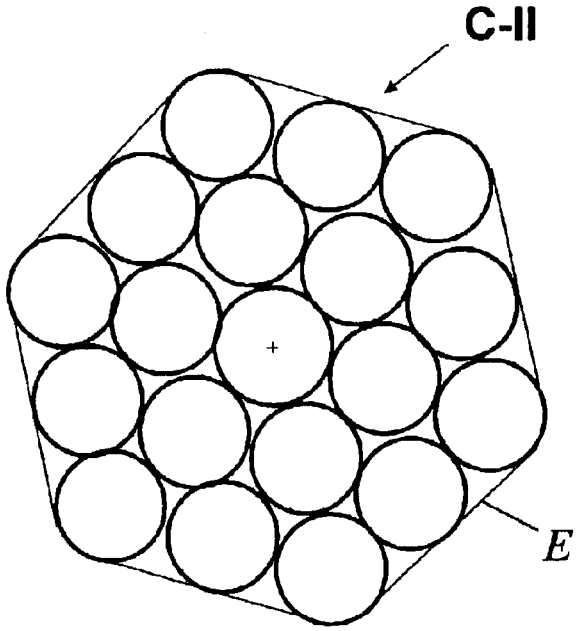
Figure 3:
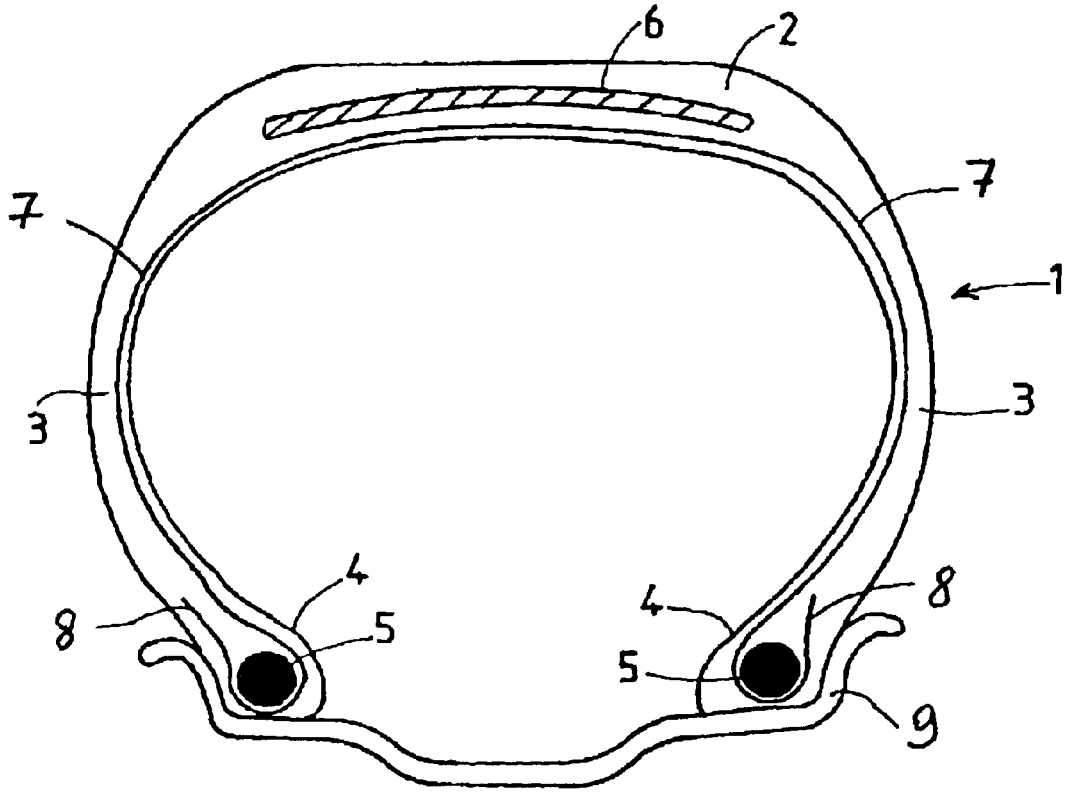

The invention and its advantages will be readily understood in the light of the description and examples of embodiment which follow, and FIGS. 1 to 3 relating to these examples, which show, respectively:

- a cross-section through a cable of structure [1+5+10] according to the invention (FIG. 1);
- a cross-section through a cable of compact structure of the prior art (FIG. 2);
- a radial section through a truck tire having a radial carcass reinforcement (FIG. 3).

I. MEASUREMENTS AND TESTS

I-1. Dynamometric Measurements

As far as the metal wires or cables are concerned, the measurements of breaking load Fm (maximum load in N), of tensile strength Rm (in MPa) and of elongation at break At (total elongation in %) are carried out under tension in accordance with ISO Standard 6892 of 1984. As far as the rubber compositions are concerned, the measurements of modulus are carried out under tension in accordance with Standard AFNOR-NFT-46002 of September 1988: the nominal secant modulus (or apparent stress, in MPa) is measured in a second elongation (i.e. after an accommodation cycle) at 10% elongation, referred to as M10 (normal conditions of temperature and humidity in accordance with Standard AFNOR-NFT-40101 of December 1979).

I-2. Air Permeability Test

The air permeability test makes it possible to measure a relative index of air permeability, "Pa". It is a simple way of indirectly measuring the degree of penetration of the cable by a rubber composition. It is performed on cables extracted directly, by decortication, from the vulcanized rubber plies which they reinforce, and which therefore have been penetrated by the cured rubber.

The test is carried out on a given length of cable (for example 2 cm) as follows: air is sent to the entry of the cable, at a given pressure (for example 1 bar), and the quantity of air is measured at the exit, using a flow meter; during the measurement, the sample of cable is locked in a seal such that only the quantity of air passing through the cable from one end to the other, along its longitudinal axis, is taken into account by the measurement. The flow measured is lower, the higher the amount of penetration of the cable by the rubber.

I-3. Belt Test

The "belt" test is a known fatigue test which was described, for example, in applications EP-A-0 648 891 or WO98/41682 mentioned above, the steel cables to be tested being incorporated in a rubber article which is vulcanized.

The principle thereof is as follows: the rubber article is an endless belt produced with a known rubber-based mixture, similar to those which are currently used for radial tire carcasses. The axis of each cable is oriented in the longitudinal direction of the belt and the cables are separated from the faces of the latter by a thickness of rubber of about 1 mm. When the belt is arranged so as to form a cylinder of revolution, the cable forms a helical winding of the same axis as this cylinder (for example, helix pitch equal to about 2.5 mm).

This belt is then subjected to the following stresses: the belt is rotated around two rollers, such that each elementary portion of each cable is subjected to a tension of 12% of the initial breaking load and is subjected to cycles of variation of curvature which make it pass from an infinite radius of curvature to a radius of curvature of 40 mm, and this over 50 million cycles.

The test is carried out under a controlled atmosphere, the temperature and the humidity of the air in contact with the belt being kept at about 20° C. and 60% relative humidity. The duration of the stresses for each belt is of the order of 3 weeks. At the end of these stresses, the cables are extracted from the belts by decortication, and the residual breaking load of the wires of the fatigued cables is measured.

Furthermore, a belt is manufactured which is identical to the previous one, and it is decorticated in the same manner as previously, but this time without subjecting the cables to the fatigue test. Thus the initial breaking load of the wires of the non-fatigued cables is measured.

Finally the breaking-load degeneration after fatigue is calculated (referred to as ΔFm and expressed in %), by comparing the residual breaking load with the initial breaking load.

This degeneration ΔFm is due in known manner to the fatigue and wear of the wires which are caused by the joint action of the stresses and the water coming from the ambient air, these conditions being comparable to those to which the reinforcement cables are subjected in tire carcasses.

I-4. Undulating Traction Test

The "undulating traction" test is a fatigue test well-known to the person skilled in the art, in which the material tested is fatigued in a pure uni-axial extension (extension-extension), that is to say without compressive stress.

The principle is as follows: a sample of the cable to be tested, which is held at each of its two ends by the two jaws of a traction machine, is subjected to a tensile or extensional stress, the intensity a of which varies cyclically and symmetrically ($\sigma_{avg}\pm\sigma_a$) about an average value ($\sigma_{avg}$), between two extreme values $\sigma_{min}$ ($\sigma_{avg}-\sigma_a$) and $\sigma_{max}$ ($\sigma_{avg}+\sigma_a$) surrounding this average value, at a given ratio of load "R"=($\sigma_{min}/\sigma_{max}$) The average stress $\sigma_{avg}$ is therefore linked to the ratio of load R and to the amplitude $\sigma_a$ by the relationship $\sigma_{avg}=\sigma_a(1+R)/(1-R)$.

In practice, the test is performed as follows: a first amplitude of stress $\sigma_a$ is selected (generally within a range of the order of ¼ to ⅓ of the resistance Rm of the cable) and the fatigue test is started for a maximum number of $10^5$ cycles (frequency 30 Hz), the load ratio R being set to 0. 1. Depending on the result obtained—i.e. breaking or non-breaking of the cable after this maximum of $10^5$ cycles—a new amplitude $\sigma_a$ is applied (less or greater than the previous one, respectively) to a new test piece, by varying this value $\sigma_a$ in accordance with the so-called steps method (Dixon & Mood; Journal of the American statistical association, 43, 1948, 109–126). Thus a total of 17 iterations are effected, the statistical treatment of the tests which is defined by this steps method resulting in the determination of an endurance limit—$\sigma_d$—which corresponds to a 50% probability of breaking of the cable at the end of the $10^5$ fatigue cycles.

For this test, a tensile fatigue machine manufactured by Schenck (Model PSA) is used; the useful length between the two jaws is 10 cm; the measurement is effected in a controlled dry atmosphere (amount of relative humidity less than or equal to 5%; temperature 20° C.).

I-5. Test of Endurance in the Tire

The endurance of the cables under fatigue-fretting-corrosion is evaluated in carcass plies of truck tires for a very long-duration running test.

For this, truck tires are manufactured, the carcass reinforcement of which is formed of a single rubberised ply reinforced by the cables to be tested. These tires are mounted on suitable known rims and are inflated to the same pressure (with an excess pressure relative to nominal pressure) with air saturated with moisture. Then these tires are run on an automatic running machine under a very high load (overload relative to the nominal load) and at the same speed, for a given number of kilometers. At the end of the running, the cables are extracted from the tire carcass by decortication, and the residual breaking load is measured both on the wires and on the cables thus fatigued.

Furthermore, tires identical to the previous ones are manufactured and they are decorticated in the same manner as previously, but this time without subjecting them to running. Thus the initial breaking load of the non-fatigued wires and cables is measured after decortication.

Finally the breaking-load degeneration after fatigue is calculated (referred to as ΔFm and expressed in %), by comparing the residual breaking load with the initial breaking load. This degeneration ΔFm is due to the fatigue and wear (reduction in section) of the wires which are caused by the joint action of the various mechanical stresses, in particular the intense working of the contact forces between the wires, and the water coming from the ambient air, in other words to the fatigue-fretting-corrosion to which the cable is subjected within the tire during running.

It may also be decided to perform the running test until forced destruction of the tire occurs, owing to a break in the carcass ply or another type of damage occurring earlier (for example detreading).

II. DETAILED DESCRIPTION OF THE INVENTION

II-1. Cable of the Invention

The terms "formula" or "structure", when used in the present description to describe the cables, refer simply to the construction of these cables.

The cable of the invention is a multi-layer cable comprising a core (C0) of diameter $d_0$, an intermediate layer (C1) of 4 or 5 wires (M=4 or 5) of diameter $d_1$ and an unsaturated outer layer (C2) of N wires of diameter $d_2$, N being less by 1 to 3 than the maximum number $N_{max}$ of wires which can be wound in a single layer around the layer C1.

In this layered cable of the invention, the diameter of the core and that of the wires of the layers C1 and C2, the helix pitches (and hence the angles) and the directions of winding of the different layers are defined by all the characteristics cited hereafter ($d_0$, $d_1$, $d_2$, $p_1$ and $p_2$ expressed in mm):

$$0.08<d_0<0.28; \quad \text{(i)}$$

$$0.15<d_1<0.28; \quad \text{(ii)}$$

$$0.12<d_2<0.25; \quad \text{(iii)}$$

$$\text{for } M=4: 0.40<(d_0/d_1)<0.80; \quad \text{(iv)}$$

$$\text{for } M=5: 0.70<(d_0/d_1)<1.10;$$

$$4.8\pi(d_0+d_1)<p_1<p_2<5.6\pi(d_0+2d_1+d_2); \quad \text{(v)}$$

the wires of layers C1 and C2 are wound in the same direction of twist. (vi)

Characteristics (i) to (vi) above, in combination, make it possible to obtain, all at once:

contact forces which are sufficient but limited between C0 and C1, which are beneficial for reduced wear and less fatigue of the wires of layer C1;

reduced wear by fretting between the wires of layers C1 and C2, despite the presence of different pitches ($p_1 \neq p_2$) between the two layers C1 and C2;

due in particular to optimisation of the ratio of the diameters ($d_0/d_1$) and the helix angles formed by the wires of layers C1 and C2, optimum penetration of the rubber through layers C1 and C2 and as far as the center C0 of the latter, which firstly ensures very high protection against corrosion or the possible propagation thereof, and secondly minimal disorganisation of the cable under high flexural stress.

Thus, owing to its specific structure, the cable of the invention, which is already self-wrapped, does not generally require the use of an external wrapping wire around the layer C2; this advantageously solves the problems of wear between the wrapping wire and the wires of the outermost layer of the cable.

However, of course, the cable of the invention might also comprise such an external wrap, formed for example of a (at least one) single wire wound in a helix about the outer layer C2, in a helix pitch which is preferably shorter than that of the layer C2, and a direction of winding opposite or identical to that of this outer layer.

In order to reinforce still further the specific wrapping effect provided by the layer C2, the cable of the invention, in particular when it is devoid of such an external wrapping wire, preferably fulfills characteristic (vii) hereafter:

$$5.0\pi(d_0+d_1)<p_1<p_2<5.0\pi(d_0+2d_1+d_2). \quad \text{(vii)}$$

Characteristics (v) and (vi)—different pitches $p_1$ and $p_2$, and layers C1 and C2 wound in the same direction of twist—mean that, in known manner, the wires of layers C1 and C2 are essentially arranged in two adjacent, concentric cylindrical (i.e. tubular) layers. So-called "tubular" or "cylindrical" layered cables are thus understood to be cables formed of a core (i.e. core part or central part) and one or more concentric layers, each tubular in shape, arranged around this core, such that, at least in the cable at rest, the thickness of each layer is substantially equal to the diameter of the wires which form it; as a result, the cross-section of the cable has a contour or shell (E) which is substantially circular, as illustrated for example in FIG. 1.

The cables having cylindrical or tubular layers of the invention must in particular not be confused with so-called "compact" layered cables, which are assemblies of wires wound with the same pitch and in the same direction of twist; in such cables, the compactness is such that practically no distinct layer of wires is visible; as a result, the cross-section of such cables has a contour (E) which is no longer circular, but polygonal, as illustrated for example in FIG. 2.

The outer layer C2 is a tubular layer of N wires which is referred to as "unsaturated" or "incomplete", that is to say that, by definition, there is sufficient space in this tubular layer C2 to add at least one (N+1)th wire of diameter $d_2$, several of the N wires possibly being in contact with one another. Reciprocally, this tubular layer C2 would be referred to as "saturated" or "complete" if there was not enough space in this layer to add at least one (N+1)th wire of diameter $d_2$.

Preferably, the cable of the invention is a layered cable of construction [1+M+N], that is to say that its core is formed of a single wire, as shown, for example, in FIG. 1 (cable referenced C-I).

This FIG. 1 shows a section perpendicular to the axis (O) of the core and of the cable, the cable being assumed to be rectilinear and at rest. It can be seen that the core C0 (diameter $d_0$) is formed of a single wire; it is surrounded by and in contact with an intermediate layer C1 of 5 wires of diameter $d_1$ which are wound together in a helix at a pitch $p_1$; this layer C1, which is of a thickness substantially equal to $d_1$, is itself surrounded by and in contact with an outer layer C2 of 10 wires of diameter $d_2$ which are wound together in a helix at a pitch $p_2$, and therefore of a thickness substantially equal to $d_2$. The wires wound around the core C0 are thus arranged in two adjacent, concentric, tubular layers (layer C1 of thickness substantially equal to $d_1$, then layer C2 of thickness substantially equal to $d_2$). It can be seen that the wires of layer C1 have their axes ($O_1$) arranged practically on a first circle $C_1$ shown by broken lines, whereas the wires of layer C2 have their axes ($O_2$) arranged practically on a second circle $C_2$, also shown by broken lines.

For an even better compromise of results, with regard in particular to the ability of the cable to be penetrated by the rubber and to the contact forces between the different layers, it is preferred that relationship (vii) above be satisfied, namely that the cable of the invention be wrapped or not by an external wrapping wire.

More preferably still, for these same reasons, the cable of the invention satisfies the following relationship:

$$5.3\pi(d_0+d_1)<p_1<p_2<4.7\pi(d_0+2d_1+d_2). \quad \text{(viii)}$$

By thus offsetting the pitches and therefore the angles of contact between the wires of layer C1 on one hand and those of layer C2 on the other hand, it was noted that the ability of the cable to be penetrated was improved further by increasing the surface area of the channels for penetrating between these two layers, while optimising its fatigue-fretting performance.

It will be recalled here that, according to a known definition, the pitch represents the length, measured parallel to the axis O of the cable, at the end of which a wire having this pitch makes a complete turn around the axis O of the cable; thus, if the axis O is sectioned by two planes perpendicular to the axis O and separated by a length equal to the pitch of a wire of one of the two layers C1 or C2, the axis of this wire ($O_1$ or $O_2$, respectively) has in these two planes the same position on the two circles corresponding to the layer C1 or C2 of the wire in question.

In the cable according to the invention, a preferred embodiment consists in selecting the pitches $p_1$ and $p_2$ within a range from 5 to 15 mm, $p_1$ being included in particular within a range from 5 to 10 mm and $p_2$ being included within a range from 10 to 15 mm.

The following relationship is more preferably satisfied, in particular when the cable of the invention is devoid of an external wrapping wire:

$$6<p_1<p_2<14.$$

One particular advantageous embodiment then consists of selecting $p_1$ to be between 6 and 10 mm and $p_2$ to be between 10 and 14 mm.

In the cable according to the invention, all the wires of the layers C1 and C2 are wound in the same direction of twist, that is to say either in the S direction ("S/S" arrangement) or in the Z direction ("Z/Z" arrangement). Such an arrangement of the layers C1 and C2 is somewhat contrary to the most conventional constructions of layered cables [L+M+N], in particular those of construction [3+9+15], which most frequently require crossing of the two layers C1 and C2 (or an "S/Z" or "Z/S" arrangement) so that the wires of layer C2 themselves wrap the wires of layer C1. Winding the layers C1 and C2 in the same direction advantageously makes it possible, in the cable according to the invention, to minimise the friction between these two layers C1 and C2 and therefore the wear of the wires constituting them.

In the cable of the invention, the ratios ($d_0/d_1$) must be set within given limits, according to the number M (4 or 5) of wires of the layer C1. Too low a value of this ratio is unfavourable to the wear between the core and the wires of layer C1. Too high a value adversely affects the compactness of the cable, for a level of resistance which is finally not greatly modified, and its flexibility; the increased rigidity of the core due to an excessively large diameter $d_0$ would furthermore be unfavourable to the feasibility itself of the cable during the cabling operations.

The wires of layers C1 and C2 may have a diameter which is identical or different from one layer to the other; advantageously, wires of the same diameter ($d_1=d_2$) can be used, in particular to simplify the cabling process and to reduce the costs, as shown, for example, in FIG. 1.

The maximum number $N_{max}$ of wires which can be wound in a single saturated layer around the layer C1 is of course a function of numerous parameters (diameter $d_0$ of the core, number M and diameter $d_1$ of the wires of layer C1, diameter $d_2$ of the wires of layer C2). By way of example, if $N_{max}$ is equal to 12, N may then vary from 9 to 11 (for example constructions [1+M+9], [1+M+10] or [1+M+11]); if $N_{max}$ is for example equal to 11, N may then from 8 to 10 (for example constructions [1+M+8], [1+M+9] or [1+M+10]).

Preferably, the number N of wires in the layer C2 is less by 1 to 2 than the maximum number $N_{max}$. This makes it possible, in the majority of cases, to form sufficient space between the wires for the rubber compositions to be able to infiltrate between the wires of layer C2 and to reach layer C1. Thus, the invention is preferably implemented with a cable selected from among cables of the structure [1+4+8], [1+4+9], [1+4+10], [1+5+9], [1+5+10] or [1+5+11].

By way of examples of cables according to the invention, mention will be made of cables having the following constructions and, in particular, among them, the preferred cables which satisfy at least one of the above relationships (vii) or (viii):

[1+4+8] with $d_0$=0.100 mm and $d_1=d_2$=0.200 mm;

[1+4+8] with $d_0$=0.120 mm and $d_1=d_2$=0.225 mm;

[1+4+9] with $d_0$=0.120 mm and $d_1=d_2$=0.200 mm;

[1+4+9] with $d_0$=0.150 mm and $d_1=d_2$=0.225 mm;

[1+4+10] with $d_0$=0.120 mm and $d_1=d_2$=0.175 mm;

[1+4+10] with $d_0$=0.150 mm and $d_1=d_2$=0.225 mm;

[1+5+9] with $d_0$=0.150 mm and $d_1=d_2$=0.175 mm;

[1+5+9] with $d_0$=0.175 mm and $d_1=d_2$=0.200 mm;

[1+5+10] with $d_0$=0.150 mm and $d_1=d_2$=0.17 5 mm;

[1+5+10] with $d_0=d_1=d_2$=0.200 mm;

[1+5+11] with $d_0=d_2$=0.200 mm; $d_1$=0.225 mm;

[1+5+11] with $d_0$=0.200 mm and $d_1=d_2$=0.225 mm;

[1+5+11] with $d_0=d_1=d_2$=0.225 mm;

[1+5+11] with $d_0$=0.240 mm and $d_1=d_2$=0.225 mm;

[1+5+11] with $d_0=d_2$=0.225 mm; $d_1$=0.260 mm.

It will be noted that, in these cables, at least two layers out of three (C0, C1, C2) contain wires of diameters (respectively $d_0$, $d_1$, $d_2$) which are identical.

The invention is preferably implemented, in the carcass reinforcements of truck tires, with cables of structure [1+5+N], more preferably of structure [1+5+9], [1+5+10] or [1+5+11]. More preferably still, cables of structure [1+5+10] or [1+5+11] are used.

For such [1+5+N] cables, one advantageous embodiment of the invention consists in using wires of the same diameter for the core and at least one of the layers C1 and C2, or indeed for the two layers (in this case, $d_0=d_1=d_2$), as shown for example in FIG. 1.

However, in order further to increase the ability of the cable to be penetrated by rubber, the wires of layer C1 may be selected to be of greater diameter than those of layer C2, for example in a ratio ($d_1/d_2$) which is preferably between 1.05 and 1.30.

For reasons of strength, industrial feasibility and cost, it is preferred for the diameter $d_0$ of the core to be between 0.14 and 0.28 mm.

Furthermore, for a better compromise between strength, feasibility and flexural strength of the cable on one hand and ability to be penetrated by the rubber compositions on the other hand, it is preferred that the diameters of the wires of layers C2 be between 0.15 and 0.25 mm.

For carcass reinforcements for truck tires, the diameter $d_1$ is preferably selected to be less than or equal to 0.26 mm and the diameter $d_2$ is preferably greater than 0.17 mm. A diameter $d_1$ less than or equal to 0.26 mm makes it possible to reduce the level of the stresses to which the wires are subjected upon major variations in curvature of the cables, whereas preferably diameters $d_2$ greater than 0.17 mm will be selected for reasons in particular of strength of the wires and of industrial cost; when $d_1$ and $d_2$ are selected within these preferred intervals, the diameter $d_0$ of the core is then more preferably between 0.14 and 0.25 mm.

The invention may be implemented with any type of steel wires, for example carbon steel wires and/or stainless steel wires as described, for example, in the above applications EP-A-0 648 891 or WO98/41682. Preferably a carbon steel is used, but it is of course possible to use other steels or other alloys.

When a carbon steel is used, its carbon content (% by weight of steel) is preferably between 0.50% and 1.0%, more preferably between 0.68% and 0.95%; these contents represent a good compromise between the mechanical properties required for the tire and the feasibility of the wire. It should be noted that, in applications in which the highest mechanical strengths are not necessary, advantageously carbon steels may be used, the carbon content of which is between 0.50% and 0.68%, and in particular varies from 0.55% to 0.60%, such steels ultimately being less costly because they are easier to draw. Another advantageous embodiment of the invention may also consist, depending on the intended applications, of using steels having a low carbon content of for example between 0.2% and 0.5%, owing in particular to lower costs and greater ease of drawing.

When the cables of the invention are used to reinforce carcass reinforcements for tires for industrial vehicles, their wires preferably have a tensile strength greater than 2000 MPa, more preferably greater than 3000 MPa. In the case of tires of very large dimensions, in particular wires having a tensile strength of between 3000 MPa and 4000 MPa will be selected. The person skilled in the art will know how to manufacture, for example, carbon steel wires having such strength, by adjusting in particular the carbon content of the steel and the final work-hardening ratios ($\epsilon$) of these wires.

The cable of the invention may comprise an external wrap, formed for example of a single wire, whether or not of metal, wound in a helix about the cable at a pitch shorter than that of the outer layer, and a direction of winding opposite or identical to that of this outer layer.

However, owing to its specific structure, the cable of the invention, which is already self-wrapped, does not generally require the use of an external wrapping wire, which advantageously solves the problems of wear between the wrap and the wires of the outermost layer of the cable.

However, if a wrapping wire is used, in the general case in which the wires of layer C2 are made of carbon steel, advantageously a wrapping wire of stainless steel may then be selected in order to reduce the wear by fretting of these carbon steel wires in contact with the stainless steel wrap, as taught by Application WO98/41682 referred to above, the stainless steel wire possibly being replaced in equivalent manner by a composite wire, only the skin of which is of stainless steel and the core of which is of carbon steel, as described for example in Patent Application EP-A-0 976 541.

II-2. Fabric and Tire of the Invention

The invention also relates to tires intended for industrial vehicles, more particularly truck tires and to the rubberised fabrics usable as carcass reinforcement plies for these truck tires.

By way of example, FIG. 3 shows diagrammatically a radial section through a truck tire 1 having a radial carcass reinforcement which may or may not be in accordance with the invention, in this general representation. This tire 1 comprises a crown 2, two sidewalls 3 and two beads 4, each of these beads 4 being reinforced with a bead wire 5. The crown 2, which is surmounted by a tread (not shown in this diagram) is in known manner reinforced by a crown reinforcement 6 formed for example of at least two superposed crossed plies, which are reinforced by known metal cables. A carcass reinforcement 7 is wound around the two bead wires 5 within each bead 4, the upturn 8 of this reinforcement 7 being for example arranged towards the outside of the tire 1, which is shown here mounted on its rim 9. The carcass reinforcement 7 is formed of at least one ply reinforced by so-called "radial" cables, that is to say that these cables are arranged practically parallel to each other and extend from one bead to the other so as to form an angle of between 80° and 90° with the median circumferential plane (plane perpendicular to the axis of rotation of the tire which is located halfway between the two beads 4 and passes through the center of the crown reinforcement 6).

The tire according to the invention is characterised in that its carcass reinforcement 7 comprises at least one carcass ply, the radial cables of which are multi-layer steel cables according to the invention.

In this carcass ply, the density of the cables according to the invention is preferably between 40 and 100 cables per dm (decimeter) of radial ply, more preferably between 50 and 80 cables per dm, the distance between two adjacent radial cables, from axis to axis, thus being preferably between 1.0 and 2.5 mm, more preferably between 1.25 and 2.0 mm. The cables according to the invention are preferably arranged such that the width ("l") of the rubber bridge, between two adjacent cables, is between 0.35 and 1 mm. This width l in known manner represents the difference between the calendering pitch (laying pitch of the cable in the rubber fabric) and the diameter of the cable. Below the minimum value indicated, the rubber bridge, which is too narrow, risks mechanically degrading during working of the ply, in particular during the deformation which it experiences in its own plane by extension or shearing. Beyond the maximum indicated, there are risks of flaws in appearance occurring on the sidewalls of the tires or of penetration of objects, by perforation, between the cables. More preferably, for these same reasons, the width "l" is selected between 0.4 and 0.8 mm.

The values advocated above, of density of the cables, distance between adjacent cables and of width "l" of the rubber bridge are those measured both on the fabric as such in the uncured state (i.e. before incorporation in the tire) and in the tire itself, in this latter case measured beneath the bead wire of the tire.

Preferably, the rubber composition used for the fabric of the carcass ply has, when vulcanized, (i.e. after curing) a secant tensile modulus M10 which is less than 8 MPa, more preferably between 4 and 8 MPa. It is within such a range of moduli that the best compromise of endurance between the cables of the invention on one hand and the fabrics reinforced by these cables on the other hand has been recorded.

By way of example, for manufacturing the tires of the invention, the procedure is as follows. The above layered cables are incorporated by calendering on a rubberised fabric formed of a known composition based on natural rubber and carbon black as reinforcing filler, which is conventionally used for manufacturing carcass reinforcement plies for radial truck tires. The tires are then manufactured in known manner, and are such as shown diagrammatically in FIG. 3, which has already been commented on. Their radial carcass reinforcement 7 is, by way of example, formed of a single radial ply formed of the rubberised fabric above, the radial cables of the invention being arranged at an angle of about 90° with the median circumferential plane. The crown reinforcement 6 thereof is in known manner formed of two crossed superposed working plies, reinforced with metal cables inclined by 22 degrees, these two working plies being covered by a protective crown ply reinforced by "elastic" metal cables (i.e. cables of high elongation). In each of these crown reinforcement plies, the metal cables used are known conventional cables, which are arranged substantially parallel to each other, and the angles of inclination indicated are measured relative to the median circumferential plane.

III. EXAMPLES OF EMBODIMENT OF THE INVENTION

III-1. Nature and Properties of the Wires Used

To produce the examples of cables whether or not in accordance with the invention, fine carbon steel wires are used which are prepared in accordance with known methods such as are described, for example, in applications EP-A-0 648 891 or WO98/41682 mentioned above, starting from commercial wires, the initial diameter of which is approximately 1 mm. The steel used is a known carbon steel (USA Standard AISI 1069), the carbon content of which is approx. 0.7%, comprising approximately 0.5% manganese and 0.2% silicon, the remainder being formed of iron and the usual inevitable impurities linked to the manufacturing process for the steel.

The commercial starting wires first undergo known a degreasing and/or pickling treatment before their later working. At this stage, their tensile strength is equal to about 1150 MPa, and their elongation at break is approximately 10%. Then copper is deposited on each wire, followed by a deposit of zinc, electrolytically at ambient temperature, and then the wire is heated thermally by Joule effect to 540° C.

to obtain brass by diffusion of the copper and zinc, the weight ratio (phase α)/(phase α+phase β) being equal to approximately 0.85. No heat treatment is performed on the wire once the brass coating has been obtained.

Then so-called "final" work-hardening is effected on each wire (i.e. implemented after the final heat treatment), by cold-drawing in a wet medium with a drawing lubricant which is in the form of an emulsion in water. This wet drawing is effected in known manner in order to obtain the final work-hardening ratio (ϵ), calculated from the initial diameter indicated above for the commercial starting wires.

By definition, the ratio of a work-hardening operation, ϵ, is given by the formula $\epsilon = \mathrm{Ln}\,(S_i/S_f)$, in which Ln is the Naperian logarithm, $S_i$ represents the initial section of the wire before this work-hardening and $S_f$ the final section of the wire after this work-hardening.

By adjusting the final work-hardening ratio, thus two groups of wires of different diameters are prepared, a first group of wires of average diameter 4 equal to approximately 0.200 mm (ϵ=3.2) for the wires of index 1 (wires marked F1) and a second group of wires of average diameter ϕ equal to approximately 0.175 mm (ϵ=3.5) for the wires of index 2 (wires marked F2).

The steel wires thus drawn have the mechanical properties indicated in Table 1.

TABLE 1

| Wires | ϕ (mm) | Fm (N) | At (%) | Rm (MPa) |
|---|---|---|---|---|
| F1 | 0.200 | 82 | 1.8 | 2720 |
| F2 | 0.175 | 62 | 2.1 | 2860 |

The elongation At shown for the wires is the total elongation recorded upon breaking of the wire, that is to say integrating both the elastic portion of the elongation (Hooke's Law) and the plastic portion of the elongation.

The brass coating which surrounds the wires is of very low thickness, significantly less than one micrometer, for example of the order of 0.15 to 0.30 μm, which is negligible compared with the diameter of the steel wires. Of course, the composition of the steel of the wire in its different elements (for example C, Mn, Si) is the same as that of the steel of the starting wire.

It will be recalled that during the process of manufacturing the wires, the brass coating facilitates the drawing of the wire, as well as the gluing of the wire to the rubber. Of course, the wires could be covered with a fine metal layer other than brass, having for example the function of improving the corrosion resistance of these wires and/or the adhesion thereof to the rubber, for example a fine layer of Co, Ni, Zn, Al, or of an alloy of two or more of the compounds Cu, Zn, Al, Ni, Co, Sn.

III-2. Production of the Cables

The above wires are then assembled in the form of layered cables of structure [1+5+10] for the cable according to the invention (cable C-I), of structure [1+6+12] for the cable of the prior art (cable C-II); the wires F1 are used to form the core C0 of these cables C-I and C-II, as well as the layers C1 and C2 of the cable C-I according to the invention, while the wires F2 are used to form the layers C1 and C2 of the control cable C-II.

These cables are manufactured using cabling devices (Barmag cabler) and using processes well-known to the person skilled in the art which are not described here in order to simplify the description. The cable C-II is manufactured in a single cabling operation ($p_1=p_2$), whereas the cable C-I, owing to its different pitches $p_1$ and $p_2$, requires two successive operations (manufacture of a [1+5] cable then cabling of the final layer around this [1+5] cable), these two operations possibly advantageously being effected in-line using two cablers arranged in series.

The cable C-I according to the invention has the following characteristics:

structure [1+5+10]

$d_0=d_1=d_2=0.200$;

$(d_0/d_1)=1.00$;

$p_1=8(Z)$; $p_2=11\ (Z)$.

The control cable C-II has the following characteristics:

structure [1+6+12]

$d_0=0.200$;

$d_1=d_2=0.175$;

$(d_0/d_1)=1.14$;

$p_1=10\ (Z)$; $p_2=10(Z)$.

Whatever the cables, the wires F2 of layers C1 and C2 are wound in the same direction of twist (Z direction).

The two cables tested are devoid of wrap and have a diameter of approximately 1.0 mm for cable C-I, and approximately 0.90 mm for cable C-II. The diameter $d_0$ of the core of these cables is the same diameter as that of its single wire F1, which is practically devoid of torsion on itself.

The cable of the invention C-I is a cable having tubular layers as shown in cross-section in FIG. 1, which has already been commented on. It is distinguished from the conventional cables of the prior art in particular by the fact that its intermediate layer C1 and outer layer C2 comprise, respectively, one and two wires less than a conventional saturated cable, and that its pitches $p_1$ and $p_2$ are different, while furthermore satisfying the relationship (v) above. In this cable C-I, N is less by 2 than the maximum number (here $N_{max}=12$) of wires which can be wound in a single saturated layer around the layer C1.

The control cable C-II is a compact layered cable as shown in FIG. 2. It can be seen in particular from this cross-section of FIG. 2 that cable C-II, although of similar construction, owing to its method of cabling (wires wound in the same direction and pitches $p_1$ and $p_2$ being equal) has a far more compact structure than that of cable C-I; as a result, no tubular layer of wires is visible for this cable, the cross-section of this cable C-II having a contour E which is no longer circular but hexagonal.

It will be noted that the cable C-I of the invention (M=5) does satisfy the following characteristics:

$$0.08<d_0<0.28; \quad \text{(i)}$$

$$0.15<d_1<0.28; \quad \text{(ii)}$$

$$0.12<d_2<0.25; \quad \text{(iii)}$$

$$\text{for } M=4{:}\,0.40<(d_0/d_1)<0.80; \quad \text{(iv)}$$

$$\text{for } M=5{:}\,0.70<(d_0/d_1)<1.10;$$

$$4.8\pi(d_0+d_1)<p_1<p_2<5.6\pi(d_0+2d_1+d_2); \quad \text{(v)}$$

the wires of layers C1 and C2 are wound in the same direction of twist. (vi)

This cable C-I furthermore satisfies each of the following preferred relationships:

$d_2>0.17$;

$d_1\leqq 0.26$;

$0.14<d_0<0.25$;

$6<p_1<p_2<14$.

Furthermore, it satisfies each of the relationships (vii) and (viii) above.

The mechanical properties of cables C-I and C-II are set forth in Table 2 below:

TABLE 2

| Cable | Fm (N) | At (%) | Rm (MPa) |
|---|---|---|---|
| C-I | 1250 | 2.6 | 2650 |
| C-II | 1255 | 2.8 | 2750 |

The elongation At shown for the cable is the total elongation recorded upon breaking of the cable, that is to say integrating all of the following: the elastic portion of the elongation (Hooke's Law), the plastic portion of the elongation and the so-called structural portion of the elongation, which is inherent to the specific geometry of the cable tested.

III-3. Endurance Tests (Belt Test)

The above layered cables are incorporated by calendering on a rubberised fabric formed of a known composition based on natural rubber and carbon black as reinforcing filler, which is conventionally used for manufacturing carcass reinforcement plies for radial truck tires (modulus M10 equal to approximately 6 MPa, after curing). This composition essentially comprises, in addition to the elastomer and the reinforcing filler, an antioxidant, stearic acid, an extender oil, cobalt naphthenate as adhesion promoter, and finally a vulcanization system (sulphur, accelerator, ZnO). In the rubber fabric, the cables are arranged parallel in known manner, at a cable density of the order of 63 cables per dm (decimeter) of ply, which, taking into account the diameter of the cables, is equivalent to a width "l" of the rubber bridges, between two adjacent cables, of approximately 0.6 mm for the cable of the invention, and about 0.7 mm for the control cable, The fabrics thus prepared are subjected to the belt test described in section I-3. After fatigue, decortication, that is to say extraction of the cables from the belts, is effected. The cables are then subjected to tensile tests, by measuring each time the residual breaking load (cable extracted from the belt after fatigue) of each type of wire, according to the position of the wire in the cable, and for each of the cables tested, and by comparing it to the initial breaking load (cables extracted from the new belts).

The average degenerations ΔFm are given in % in Table 3; they are calculated both for the core wires (C0) and for the wires of layers C1 and C2. The overall degenerations ΔFm are also measured on the cables themselves.

TABLE 3

| | ΔFm (%) | | | |
|---|---|---|---|---|
| Cable | C0 | C1 | C2 | Cable |
| C-I | 14 | 11 | 7 | 8 |
| C-II | 26 | 19 | 10 | 14 |

On reading Table 3, it will be noted that, whatever the zone of the cable which is analysed (core C0, layers C1 or C2), the best results are recorded on the cable C-I according to the invention. Although the degenerations ΔFm remain fairly similar as far as the outer layer C2 is concerned (although less in the cable according to the invention), it will be noted that the farther one penetrates into the cable (layer C1 and core C0), the more the intervals become in favour of the cable according to the invention; the degenerations ΔFm of the core and of the layer C1 are virtually twice as low in the cable of the invention. The overall degeneration of the cable of the invention is substantially less than that of the control cable (8% instead of 14%).

Correlatively to the above results, visual examination of the various wires shows that the phenomena of wear or fretting (erosion of material at the points of contact), which result from repeated friction of the wires on each other, are substantially reduced in the cable C-I compared with the cable C-II.

These results are unexpected given that the person skilled in the art might expect, on the contrary, that the selection of different helix pitches $p_1$ and $p_2$ in the cable according to the invention, and hence the presence of different angles of contact between the layers C1 and C2—the effect of which is to reduce the contact surfaces and hence to increase the contact pressures between the wires of layers C1 and C2—would on the contrary result in an increase in the friction and hence the wear between the wires, and ultimately would adversely affect the cable according to the invention. Such is not the case.

III-4. Air Permeability Tests

The endurance results described previously appear to be well correlated to the amount of penetrability of the cables by the rubber, as explained hereafter.

The non-fatigued cables C-I and C-II (after extraction from the new belts) were subjected to the air permeability test described in section I-2, by measuring the amount of air passing through the cables in 1 minute (average of 10 measurements). The permeability indices Pa obtained are set forth in Table 4 (in relative units): the values indicated correspond to the average of 10 samples taken at different points on the belts, the base 100 being used for the control cables C-II.

TABLE 4

| Cable | Average Pa |
|---|---|
| C-I | 17 |
| C-II | 100 |

It will be noted that the cable according to the invention has an air permeability index Pa which is significantly lower (approximately factor of 5) than that of the control C-II, and hence a significantly higher amount of penetration by the rubber.

Its specific construction makes it possible, during the moulding and/or curing of the tires, for virtually complete migration of the rubber within the cable to occur, as far as the center of the latter, without forming empty channels. The cable, which is thus rendered impermeable by the rubber, is protected from the flows of oxygen and moisture which pass, for example, from the sidewalls or the tread of the tires towards the zones of the carcass reinforcement, where the cable, in known manner, is subjected to the most intense mechanical working.

III-5. Other Cables and Endurance Tests (Undulating Traction Test and Belt Test)

In this new series of tests, three layered cables are prepared, referenced C-III to C-V, of construction [1+5+10], these cables being or not being in accordance with the invention, in order to subject them to the undulating-traction fatigue test (section I-4).

These cables, prepared from the wires F1 described above, have the following characteristics.

Cable C-III (according to the invention):

structure [1+5+10]

$d_0=d_1=d_2=0.200$;

$(d_0/d_1)=1.00$;

$p_1=8(S)$; $p_2=11(S)$.

Cable C-IV (control):
structure [1+5+10]
$d_0=d_1=d_2=0.200$;
$(d_0/d_1)=1.00$;
$p_1=5.5(S)$; $p_2=11(S)$.

Cable C-V (control):
structure [1+5+10]
$d_0=d_1=d_2=0.200$;
$(d_0/d_1)=1.00$;
$p_1=7.5(S)$; $p_2=15(S)$.

Cable C-III has a construction similar to that of cable C-I previously tested.

Cables of structure [1+5+10] close or similar to that of the control cables C-IV or C-V above, which are characterised, inter alia, by a pitch $p_2$ which is double the pitch $p_1$, are known to the person skilled in the art; they have been described, for example, in the applications EP-A-0 675 223 or EP-A-0 744 490 referred to above. These known cables do not satisfy all the characteristics (i) to (vi) of the cables of the invention, in particular the essential characteristic (v) relating to the offset between the pitches $p_1$ and $p_2$.

None of the three cables tested comprises a wrap. Their properties are those set forth in Table 5 below:

TABLE 5

| Cable | Fm (N) | At (%) | Rm (MPa) |
|---|---|---|---|
| C-III | 1234 | 2.4 | 2560 |
| C-IV | 1213 | 2.3 | 2530 |
| C-V | 1220 | 2.0 | 2545 |

These three cables therefore have constructions and mechanical properties at break which are very similar: in the three cases, N is less by 2 than the maximum number (here $N_{max}=12$) of wires which can be wound in a single saturated layer around the layer C1; they all have a tubular-layer construction as shown in FIG. 1; the pitches $p_1$ and $p_2$ are different in each cable.

However, only cable C-III satisfies the above relationship (v), and the preferred characteristics of relationships (vii) and (viii).

In the undulating-traction fatigue test, these three cables yielded the results of Table 6; $\sigma_d$ is expressed therein in MPa and in relative units (r.u.), the base 100 being used for the cable of the invention C-III.

TABLE 6

| Cable | $\sigma_d$ (MPa) | $\sigma_d$ (r.u.) |
|---|---|---|
| C-III | 655 | 100 |
| C-IV | 600 | 92 |
| C-V | 565 | 86 |

It will be noted that, despite very similar constructions, the cable of the invention C-III is distinguished by significantly greater fatigue strength than that of the control cables, in particular greater than that of the control cable C-IV, of which it should be noted that only the pitch $p_1$ differs (5.5 mm instead of 8 mm).

The three cables of this test were furthermore subjected to the belt test previously applied to cables C-I and C-II (section III-4). They all exhibited very good performance, which was close in terms of overall degeneration of the cable ($\Delta$Fm of at most 10%). However, it is on the cable of the invention that the lowest average wear was recorded for the wires of the peripheral layer C2; this improved result should be emphasized because, in this type of cable, it is indeed the layer C2 which comprises the largest number of wires and therefore withstands most of the load.

In summary, the overall improved endurance of the cable of the invention C-III, compared with the control cables C-IV and C-V of very similar constructions, must be attributed here, first and foremost, to optimisation of the ratios of the helix angles (interval between the pitches $p_1$ and $p_2$) formed by the wires of layers C1 and C2. Due to this, there is obtained an even better compromise of results, with regard on one hand to the ability of the cable to be penetrated by the rubber and to the contact forces between the different layers.

III-6. Endurance in the Tire

A running test is performed here on truck tires intended to be mounted on a flat-seat rim, of dimension 12.00 R 20 XZE.

All the tires tested are identical, with the exception of the layered cables which reinforce their carcass reinforcements 7 (see FIG. 3).

The cables used for the carcass reinforcement 7 have the following characteristics:

Cable C-VI (according to the invention—17 wires+1 wrapping wire):
structure [1+5+11]
$d_0=d_2=0.230$;
$d_1=0.260$;
$(d_0/d_1)=0.88$;
$p_1=7.5(S)$; $p_2=15(S)$.

Cable C-VII (control—27 wires+1 wrapping wire):
structure [3+9+15]
$d_0=d_1=d_2=0.230$;
$p_0=6.5(S)$; $p_1=12.5(S)$; $p_2=18.0(Z)$.

The cable of the invention C-VI is formed of a core wire of a diameter of 0.23 mm, surrounded by an intermediate layer of 5 wires wound together in a helix (S direction) at a pitch of 7.5 mm, this core in turn being surrounded by an outer layer of 11 wires which themselves are wound together in a helix (S direction) at a pitch of 15 mm. This cable C-VI is wrapped by a single wire of diameter 0.15 mm (Rm=2800 MPa) wound in a helix (Z direction) at a pitch of 5 mm. In this cable according to the invention, N is less by 1 than the maximum number (here $N_{max}=12$) of wires which can be wound in a single saturated layer around the layer C1. It satisfies relationship (v) without however satisfying the preferred relationships (vii) and (viii). In order further to increase its ability to be penetrated by rubber, the wires of layer C1 were selected to be of greater diameter than those of layer C2, in a preferred ratio $(d_1/d_2)$ of between 1.10 and 1.20. The diameter of the cable (total bulk) is equal to about 1.49 mm.

With the exception of the wrapping wire (steel containing 0.7% carbon), all the wires of cable C-VI, referred to as F3 and F4 in Table 7 hereafter, were produced from a steel having a higher carbon content (0.82% instead of 0.71% for the control cable) in order to compensate in part for the reduction in the number of wires by increasing the strength of the steel.

Cable C-VII was selected as the control for this running test owing to its performance which is recognised by the person skilled in the art for reinforcement of truck tires of large dimensions. Cables of identical or similar structure have been described, for example, in the above applications EP-A-0 497 612, EP-A-0 669 421, EP-A-0 675 223, EP-A-0 709 236 or alternatively EP-A-0 779 390, to illustrate the prior art in this field. Cable C-VII is formed of 27 wires (referenced F5 in Table 7) of the same diameter 0.23 mm, with a core of 3 wires wound together in a helix (S direction) at a pitch of 6.5 mm, this core being surrounded by an intermediate layer of 9 wires which themselves are wound together in a helix (S direction) at a pitch of 12.5 mm, which in turn is surrounded by an outer layer of 15 wires which themselves are wound together in a helix (Z direction) at a pitch of 18.0 mm. This cable C-VII is wrapped by a single wire of diameter 0.15 mm (Rm=2800 MPa) wound in a helix (S direction) at a pitch of 3.5 mm. Its diameter (total bulk) is equal to about 1.65 mm.

The wires F3, F4 and F5 are brass-coated wires, prepared in known manner as indicated above in section III-1 for the wires F1 and F2. The two cables tested and their constituent wires have the mechanical properties indicated in Table 7.

TABLE 7

| Wire or cable | ϕ (mm) | Fm (N) | At (%) | Rm (MPa) |
|---|---|---|---|---|
| F3 | 0.23 | 125 | 1.8 | 3100 |
| F4 | 0.26 | 165 | 1.8 | 3070 |
| F5 | 0.23 | 115 | 1.8 | 2840 |
| C-VI | 1.49 | 2195 | 2.8 | 2830 |
| C-VII | 1.65 | 2870 | 2.7 | 2580 |

The carcass reinforcement 7 of the tires tested is formed of a single radial ply formed of the rubberised fabrics of the same type as those used previously for the belt test (section III-3 above): composition based on natural rubber and carbon black, having a modulus M10 of approximately 6 MPa.

The reinforcement 7 is reinforced either by cables according to the invention (C-VI), or by the control cables (C-VII). The fabric according to the invention comprises approximately 53 cables per dm of ply, which is equivalent to a distance between two adjacent radial cables, from axis to axis, of approximately 1.9 mm and to a width f of the rubber bridge of about 0.41 mm. The control fabric comprises approximately 45 cables per dm of ply, which is equivalent to a distance between two adjacent radial cables, from axis to axis, of approximately 2.2 mm and to a width l of about 0.55 mm.

The mass of metal in the carcass reinforcement of the tire according to the invention is thus reduced by 23% relative to the control tire, which constitutes a very substantial reduction in weight. Correlatively, owing to the use of an "HR"-type steel (0.82% carbon) for the wires of the cable C-VI, the reduction in strength of the fabric according to the invention is only about 13%.

As for the crown reinforcement 6, it is in known manner formed of (i) two crossed superposed working plies, reinforced with metal cables inclined by 22 degrees, these two working plies being covered by (ii) a protective crown ply reinforced by elastic metal cables inclined at 22 degrees. In each of these crown reinforcement plies, the metal cables used are known conventional cables, which are arranged substantially parallel to each other, and all the angles of inclination indicated are measured relative to the median circumferential plane.

A series of two tires (referenced P-1) is reinforced by the cable C-VI, and another series of two tires (referenced P-2) is reinforced by the control cable C-VII. In each series, one tire is intended for running, and the other for decortication on a new tire. The tires P-1 therefore constitute the series in accordance with the invention, and tires P-2 the control series.

These tires are subjected to a stringent running test as described in section I-5, with a total of 150,000 km covered. The distance imposed on each type of tire is very great; it is equivalent to continuous running of a duration of approximately three months and to 50 million fatigue cycles.

Despite these very severe running conditions, the two tires tested run without damage until the end of the test, in particular without breaking of the cables of the carcass ply; this illustrates in particular for the person skilled in the art the high performance of the two types of tires, including the control tires.

After running, decortication is effected, that is to say extraction of the cables from the tires. The cables are then subjected to tensile tests, by measuring each time the initial breaking load (cable extracted from the new tire) and the residual breaking load (cable extracted from the tire after running) of each type of wire, according to the position of the wire in the cable, and for each of the cables tested. The average degeneration ΔFm given in % in Table 8 is calculated both for the core wires (C0) and for the wires of layers C1 and C2. The overall degenerations ΔFm are also measured on the cables themselves.

TABLE 8

| | ΔFm (%) | | | |
|---|---|---|---|---|
| Cable | C0 | C1 | C2 | Cable |
| C-VI | 7 | 11 | 18 | 15 |
| C-VII | 7 | 22 | 16 | 17 |

On reading Table 8, it will be noted that the carcass reinforcement of the tire according to the invention, although very substantially lightened, and the metal cables of the invention which reinforce it, although significantly smaller, have an overall endurance equivalent to that of the control solution, with furthermore another advantage of the invention lying in lesser wear (half less) of the wires of the layer C1; this lesser wear of the wires of layer C1 is probably due to the optimised construction of the cable of the invention, namely winding in the same direction (here S/S) of the layers C1 and C2, contrary to the crossed construction (S/Z) of the layers C1 and C2 of the control cable.

The non-fatigued cables C-VI and C-VII (after extraction from the new tires) were furthermore subjected to the air permeability test (section I-2). The results of Table 9 clearly emphasise, if it were needed, the superiority of the cable of the invention; the permeability indices Pa are expressed in relative units, the base 100 being unchanged relative to Table 4 above (base 100 for the control cable C-II).

TABLE 9

| Cable | Average Pa |
|---|---|
| C-VI | 1 |
| C-VII | >370 |

In conclusion, as clearly shown by the various tests above, the cables of the invention make it possible to reduce significantly the phenomena of fatigue-fretting-corrosion in the carcass reinforcements of tires, in particular truck tires, and thus to improve the longevity of these reinforcements and tires.

Thus, for an equivalent life, the invention makes it possible to reduce the size of the cables and thus to reduce the weight of these carcass reinforcements and these tires.

Of course, the invention is not limited to the examples of embodiment described above.

Thus, for example, the core C0 of the cables of the invention might be formed of a wire of non-circular section, for example, one which is plastically deformed, in particular a wire of substantially oval or polygonal section, for example triangular, square or alternatively rectangular; the core C0 might also consist in a preformed wire, whether or not of circular section, for example an undulating or corkscrewed wire, or one twisted into the shape of a helix or a zigzag. In such cases, it should of course be understood that the diameter do of the core represents the diameter of the imaginary cylinder of revolution which surrounds the core wire (diameter of bulk), and not the diameter (or any other transverse size, if its section is not circular) of the core wire itself. The same would apply if the core C0 were formed not of a single wire as in the above examples, but of several wires assembled together, for example two wires arranged parallel to each other or alternatively twisted together, in a direction of twist which may or may not be identical to that of the intermediate layer C1.

For reasons of industrial feasibility, cost and overall performance, it is however preferred to implement the invention with a single conventional linear core wire, of circular section.

Furthermore, since the core wire is less stressed during the cabling operation than the other wires, bearing in mind its position in the cable, it is not necessary for this wire to use, for example, steel compositions which offer high ductility in torsion; advantageously, any type of steel could be used, for example a stainless steel, in order to result, for example, in a hybrid steel [1+5+10] or [1+5+11] cable such as described in the aforementioned application WO98/41682, comprising a stainless steel wire at the center and 15 or 16 carbon steel wires around it.

Of course (at least) one linear wire of one of the two layers C1 and/or C2 might also be replaced by a preformed or deformed wire, or more generally by a wire of section different from that of the other wires of diameter $d_1$ and/or $d_2$, so as, for example, to improve still further the ability of the cable to be penetrated by the rubber or any other material, the diameter of bulk of this replacement wire possibly being less than, equal to or greater than the diameter ($d_1$ and/or $d_2$) of the other wires constituting the layer (C1 and/or C2) in question.

Without modifying the spirit of the invention, all or part of the wires constituting the cable according to the invention might be constituted of wires other than steel wires, whether metallic or not, in particular wires of inorganic or organic material of high mechanical strength, for example monofilaments of liquid-crystal organic polymers such as described in Application WO92/12018.

The invention also relates to any multi-strand steel cable ("multi-strand rope"), the structure of which incorporates, at least, as the elementary strand, a layered cable according to the invention.

What is claimed is:

1. A multi-layer cable having a unsaturated outer layer, usable as a reinforcing element for a tire carcass reinforcement, comprising a core (C0) of diameter $d_0$ surrounded by an intermediate layer (C1) of four or five wires (M=4 or 5) of diameter $d_1$ wound together in a helix at a pitch $p_1$, this layer C1 itself being surrounded by an outer layer (C2) of N wires of diameter $d_2$ wound together in a helix at a pitch $p_2$, N being less by 1 to 3 than the maximum number $N_{max}$ of wires which can be wound in one layer about the layer C1, this cable having the following characteristics ($d_0$, $d_1$, $d_2$, $p_1$ and $p_2$ in mm):

$$0.08<d_0<0.28; \quad \text{(i)}$$

$$0.15<d_1<0.28; \quad \text{(ii)}$$

$$0.12<d_2<0.25; \quad \text{(iii)}$$

$$\text{for } M=4: 0.40<(d_0/d_1)<0.80; \quad \text{(iv)}$$

$$\text{for } M=5: 0.70<(d_0/d_1)<1.10;$$

$$4.8\pi(d_0+d_1)<p_1<p_2<5.6\pi(d_0+2d_1+d_2); \quad \text{(v)}$$

the wires of layers C1 and C2 are wound in the same direction of twist. (vi)

2. A cable according to claim 1, of construction [1+M+N], the core of which is formed of a single wire.

3. A cable according to claim 2, selected from the group consisting of cables of the constructions [1+4+8], [1+4+9], [1+4+10], [1+5+9], [1+5+10] and [1+5+11].

4. A cable according to claim 2, of construction [1+5+N].

5. A cable according to claim 4, of construction [1+5+10].

6. A cable according to claim 1, characterised in that the pitches $p_1$ and $p_2$ are within a range from 5 to 15 mm.

7. A cable according to claim 1, which satisfies the following relationship:

$$0.15<d_2<0.25.$$

8. A cable according to claim 7, which satisfies the following relationships:

$0.14<d_0<0.25$;

$d_2>0.17$;

$d_1 \leqq 0.26$.

9. A cable according to claim 1, characterised in that it is a steel cable.

10. A cable according to claim 9, characterised in that the steel is a carbon steel.

11. A cable according to claim 1, which satisfies the relationship:

$$5.0\pi(d_0+d_1)<p_1<p_2<5.0\pi(d_0+2d_1+d_2).$$

12. A cable according to claim 11, which satisfies the relationship:

$$5.3\pi(d_0+d_1)<p_1<p_2<4.7\pi(d_0+2d_1+d_2).$$

13. A cable according to claim 1, in which the ratio ($d_1/d_2$) is between 1.05 and 1.30.

14. A cable according to claim 13, in which the ratio ($d_1/d_2$) is between 1.10 and 1.20.

15. The cable of claim 1, further comprising wherein the core is comprised of L wires, wherein L is equal to or greater than 2.

16. A composite fabric usable as a carcass reinforcement ply for a truck tire, comprising a matrix of rubber composition reinforced by a multi-layer cable having a unsaturated outer layer, comprising a core (C0) of diameter $d_0$ surrounded by an intermediate layer (C1) of four or five wires (M=4 or 5) of diameter $d_1$ wound together in a helix at a pitch $p_1$, this layer C1 itself being surrounded by an outer layer (C2) of N wires of diameter $d_2$ wound together in a helix at a pitch $p_2$, N being less by 1 to 3 than the maximum number $N_{max}$ of wires which can be wound in one layer about the layer C1, this cable having the following characteristics ($d_0$, $d_1$, $d_2$, $p_1$ and $p_2$ in mm):

$$0.08<d_0<0.28; \quad \text{(i)}$$

$$0.15<d_1<0.28; \quad \text{(ii)}$$

$$0.12<d_2<0.25; \quad \text{(iii)}$$

$$\text{for } M=4: 0.40<(d_0/d_1)<0.80; \quad \text{(iv)}$$

$$\text{for } M=5: 0.70<(d_0/d_1)<1.10;$$

$$4.8\pi(d_0+d_1)<p_1<p_2<5.6\pi(d_0+2d_1+d_2); \quad \text{(v)}$$

the wires of layers C1 and C2 are wound in the same direction of twist. (vi)

17. A fabric according to claim 16, wherein the multi-layer cable, of construction [1+M+N], has a core formed by a single wire.

18. A fabric according to claim 17, wherein the multi-layer cable is selected from the group consisting of cables of the constructions [1+4+8], [1+4+9], [1+4+10], [1+5+9], [1+5+10] and [1+5+11].

19. A fabric according to claim 17, wherein the multi-layer cable has a construction [1+5+N].

20. A fabric according to claim 19, wherein the multi-layer cable has a construction [1+5+10].

21. A fabric according to claim 16, wherein the pitches $p_1$ and $p_2$ are within a range from 5 to 15 mm.

22. A fabric according to claim 16, wherein the following relationships are satisfied:

$$0.15<d_2<0.25.$$

23. A fabric according to claim 22, wherein the following relationships are satisfied:

$$0.14<d_0<0.25;$$

$$d_2>0.17;$$

$$d_1\leqq 0.26.$$

24. A fabric according to claim 16, characterised in that the multi-layer cable is a steel cable.

25. A fabric according to claim 24, characterised in that the steel is a carbon steel.

26. A fabric according to claim 16, wherein the following relationships are satisfied:

$$5.0\pi(d_0+d_1)<p_1<p_2<5.0\pi(d_0+2d_1+d_2).$$

27. A fabric according to claim 26, which satisfies the relationship:

$$5.3\pi(d_0+d_1)<p_1<p_2<4.7\pi(d_0+2d_1+d_2).$$

28. A fabric according to claim 16, in which the ratio $(d_1/d_2)$ is between 1.05 and 1.30.

29. A fabric according to claim 28, in which the ratio $(d_1/d_2)$ is between 1.10 and 1.20.

30. A fabric according to claim 16, further comprising wherein its cable density is between 40 and 100 cables per dm of fabric.

31. A fabric according to claim 30, the cable density being between 50 and 80 cables per dm of fabric.

32. A fabric according to claim 16, further comprising wherein the width l of the bridge of rubber composition, between two adjacent cables, is between 0.35 and 1 mm.

33. A fabric according to claim 32, wherein the width l of the bridge of rubber composition, between two adjacent cables, is between 0.4 and 0.8 mm.

34. A fabric according to claim 16, further comprising wherein the rubber composition has, in the vulcanized state, a secant tensile modulus M10 which is less than 8 MPa.

35. A fabric according to claim 34, wherein the rubber composition has, in the vulcanized state, a secant tensile modulus M10 which is between 4 and 8 MPa.

36. A fabric according to claim 16, the rubber being natural rubber.

37. A truck tire having a carcass reinforcement comprising, as reinforcing ply, a composite fabric according to claim 16.

38. A truck tire having a carcass reinforcement comprising, as reinforcing ply, a composite fabric according to claims 17 or 18.

39. A truck tire having a carcass reinforcement comprising, as reinforcing ply, a composite fabric according to claims 19 or 20.

40. A truck tire having a carcass reinforcement comprising a multi-layer cable having a unsaturated outer layer, comprising a core (C0) of diameter $d_o$ surrounded by an intermediate layer (C1) of four or five wires (M=4 or 5) of diameter $d_1$ wound together in a helix at a pitch $p_1$, this layer C1 itself being surrounded by an outer layer (C2) of N wires of diameter $d_2$ wound together in a helix at a pitch $p_2$, N being less by 1 to 3 than the maximum number $N_{max}$ of wires which can be wound in one layer about the layer C1, this cable having the following characteristics ($d_0$, $d_1$, $d_2$, $p_1$ and $p_2$ in mm):

$$0.08<d_0<0.28; \quad \text{(i)}$$

$$0.15<d_1<0.28; \quad \text{(ii)}$$

$$0.12<d_2<0.25; \quad \text{(iii)}$$

$$\text{for } M=4: 0.40<(d_0/d_1)<0.80; \quad \text{(iv)}$$

$$\text{for } M=5: 0.70<(d_0/d_1)<1.10;$$

$$4.8\pi(d_0+d_1)<p_1<p_2<5.6\pi(d_0+2d_1+d_2); \quad \text{(v)}$$

the wires of layers C1 and C2 are wound in the same direction of twist. (vi)

41. A tire according to claim 40, wherein the multi-layer cable, of construction [1+M+N], has a core formed by a single wire.

42. A tire according to claim 41, wherein the multi-layer cable is selected from among the group consisting of cables of the constructions [1+4+8], [1+4+9], [1+4+10], [1+5+9], [1+5+10] and [1+5+11].

43. A tire according to claim 41, wherein the multi-layer cable has a construction [1+5+N].

44. A tire according to claim 43, wherein the multi-layer cable has a construction [1+5+10].

45. A tire according to claim 40, wherein the pitches $p_1$ and $p_2$ are within a range from 5 to 15 mm.

46. A tire according to claim 40, wherein the following relationships are satisfied:

$$0.15<d_2<0.25.$$

47. A tire according to claim 46, wherein the following relationships are satisfied:

$$0.14<d_0<0.25;$$

$$d_2>0.17;$$

$$d_1\leqq 0.26.$$

48. A tire according to claim 40, characterised in that the multi-layer cable is a steel cable.

49. A tire according to claim 48, characterised in that the steel is a carbon steel.

50. A tire according to claim 40, wherein the following relationships are satisfied:

$$5.0\pi(d_0+d_1)<p_1<p_2<5.0\pi(d_0+2d_1+d_2).$$

51. A tire according to claim 50, which satisfies the relationship:

$$5.3\pi(d_0+d_1)<p_1<p_2<4.7\pi(d_0+2d_1+d_2).$$

52. A tire according to claim 40, in which the ratio $(d_1/d_2)$ is between 1.05 and 1.30.

53. A tire according to claim 52, in which the ratio $(d_1/d_2)$ is between 1.10 and 1.20.

* * * * *